US008565365B2

(12) United States Patent
Hempy et al.

(10) Patent No.: US 8,565,365 B2
(45) Date of Patent: Oct. 22, 2013

(54) UNIRRADIATED NUCLEAR FUEL COMPONENT TRANSPORT SYSTEM

(75) Inventors: Brian E. Hempy, Columbia, SC (US); Richard Forsythe Rochow, Forest, VA (US)

(73) Assignee: Westinghouse Electric Company LLC, Cranberry Township, PA (US)

( * ) Notice: Subject to any disclaimer, the term of this patent is extended or adjusted under 35 U.S.C. 154(b) by 539 days.

(21) Appl. No.: 12/908,932

(22) Filed: Oct. 21, 2010

(65) Prior Publication Data

US 2012/0099693 A1 Apr. 26, 2012

(51) Int. Cl.
*G21C 19/00* (2006.01)

(52) U.S. Cl.
USPC ..... 376/272

(58) Field of Classification Search
USPC ..... 376/272
See application file for complete search history.

(56) References Cited

U.S. PATENT DOCUMENTS

| | | | | |
|---|---|---|---|---|
| 4,780,268 | A | 10/1988 | Papai et al. | |
| 4,803,042 | A * | 2/1989 | Gilmore et al. | 376/272 |
| 5,274,682 | A * | 12/1993 | McDaniels, Jr. | 376/261 |
| 5,490,186 | A | 2/1996 | Gilmore | |
| 5,615,240 | A * | 3/1997 | Wolters et al. | 376/272 |
| 6,375,230 | B1 * | 4/2002 | Jensen et al. | 285/104 |
| 6,683,931 | B1 | 1/2004 | Stilwell, III et al. | |
| 6,748,042 | B1 | 6/2004 | Stilwell, III et al. | |
| 7,474,726 | B2 | 1/2009 | Hempy et al. | |

* cited by examiner

*Primary Examiner* — Jack W Keith
*Assistant Examiner* — Frank J McGue
(74) *Attorney, Agent, or Firm* — Joseph C. Spadacene; Westinghouse Electric Company LLC

(57) ABSTRACT

An unirradiated nuclear fuel assembly and fuel component shipping cask that employs a liner with a universal, removable, reusable axial restraint device that can accommodate various fuel assembly designs. The restraint device has a top shear plate with a groove that encircles its peripheral edge and mates with corresponding rails on each of the walls of the liner. The top shear plate includes an anchoring mechanism for supporting a side of the top shear plate against an abutting side of a stationary wall of the liner.

17 Claims, 6 Drawing Sheets

UNIRRADIATED NUCLEAR FUEL COMPONENT TRANSPORT SYSTEM

BACKGROUND OF THE INVENTION

1. Field of the Invention

This invention relates to a shipping container for transporting nuclear fuel components and, in particular, to such a container for transporting unirradiated nuclear fuel assemblies and control rod spider assemblies.

2. Related Art

In the shipping and storage of unirradiated nuclear fuel elements and assemblies, which contain large quantities and/or enrichments of fissile material $U^{235}$, it is necessary to assure that criticality is avoided during normal use, as well as under potential accident conditions. For example, nuclear reactor fuel shipping containers are licensed by the Nuclear Regulatory Commission (NRC) to ship specific maximum fuel enrichments; i.e., weights and weight percent $U^{235}$ for each fuel assembly design. In order for a new shipping container design to receive licensing approval, it must be demonstrated to the satisfaction of the NRC that the new container design will meet the requirements of the NRC's rules and regulations, including those defined in 10 CFR §71. These requirements define the maximum critical accident (MCA) that the shipping container and its internal support structures must endure while maintaining the sub-criticality of the fuel assembly housed therein.

U.S. Pat. No. 4,780,268, which is assigned to the assignee of the present invention, discloses a shipping container for transporting two conventional nuclear fuel assemblies having a square top nozzle, a square assembly of fuel rods and a square bottom nozzle. The container includes a support frame having a vertically extending section between the two fuel assemblies which sit side-by-side. Each fuel assembly is connected to the support frame by clamping frames which each have two pressure pads. This entire assembly is connected to the container by a shock mounting frame having a plurality of shock mountings. Sealed within the vertical section are at least two neutron absorber elements. A layer of rubber cork cushioning material separates the support frame and the vertical section from the fuel assemblies.

The top nozzle of each of the conventional fuel assemblies is held along the longitudinal axis thereof by jack posts with pressure pads that are tightened down on the square top nozzle at four places. The bottom nozzle of some of these conventional fuel assemblies has a chamfered end. These fuel assemblies are held along the longitudinal axis thereof by a bottom nozzle spacer that holds the chamfered end of the bottom nozzle.

These and other shipping containers, e.g., RCC-4, for generally square cross-sectional geometry pressurized water reactor (PWR) fuel assemblies used by the assignee of the present invention, are described in Certificate of Compliance No. 5454, U.S. Nuclear Regulatory Commission, Division of Fuel Cycle and Material Safety, Office of the Nuclear Material Safety and Safeguard, Washington, D.C. 20555.

U.S. Pat. No. 5,490,186, assigned to the assignee of the present invention, describes a completely different nuclear fuel shipping container designed for hexagonal fuel, and more particularly, for a fuel assembly design for a Soviet style VVER reactor. Still, other shipping container configurations are required for boiling water reactor fuel.

There is a need, therefore, for an improved shipping container for a nuclear fuel assembly that can be employed interchangeably with a number of nuclear reactor fuel assembly designs.

There is a further need for such a nuclear fuel assembly shipping container that can accommodate a single assembly in a light-weight, durable and licensable design.

These and other needs have been partially resolved by U.S. Pat. No. 6,683,931, issued Jan. 27, 2004 and assigned to the assignee of the instant invention. The shipping container described in this latter patent includes an elongated inner tubular liner having an axial dimension at least as long as the fuel assembly. The liner is preferably split in half along its axial dimension so that it can be separated like a clam shell for placement of the two halves of the liner around the fuel assembly. The exterior circumference of the liner is designed to be closely received within the interior of an overpack formed from an elongated tubular container having an axial dimension at least as long as the liner. Preferably, the walls of the tubular container are constructed from relatively thin shells of stainless steel and the liner is coaxially positioned within the tubular container with close-cell polyurethane disposed in between. Desirably, the inner shell includes boron impregnated stainless steel. The tubular liner enclosing the fuel assembly is slidably mounted within the overpack and the overpack is sealed at each end with end caps. The overpack preferably includes circumferential ribs that extend around the circumference of the tubular container at spaced axial locations that enhance the circumferential rigidity of the overpack and form an attachment point for peripheral shock-absorbing members. An elongated frame preferably of a birdcage design, is sized to receive the overpack within the external frame in spaced relationship with the frame. The frame is formed from axially spaced circumferential straps that are connected to circumferentially spaced, axially oriented support ribs that fixably connect the straps to form the frame design. A plurality of shock absorbers are connected between certain ones of the straps and at least two of the circumferential ribs extending around the overpack, to isolate the tubular container from a substantial amount of any impact energy experienced by the frame, should the frame be impacted.

Although the shipping container described in the aforementioned '931 patent is a substantial improvement in that it can accommodate different fuel assembly designs through the use of complementary shell liners while employing the same overpack and birdcage frame, that improvement has been taken one step further by U.S. Pat. No. 6,748,042 assigned to the assignee of the instant invention. The '042 patent describes a transport system that provides a liner and overpack system that will achieve the same objectives as the '931 patent while further improving the protective characteristics of the transport system and the ease of loading and unloading the nuclear fuel components transported therein. The shipping container includes an elongated tubular container, shell or liner designed to support a nuclear fuel product such as the fuel assembly therein. The interior of the tubular liner preferably conforms to the external envelope of the fuel assembly. The exterior of the tubular liner has at least two substantially abutting flat walls which extend axially. In the preferred embodiment, the cross section of the tubular member is rectangular or hexagonal to match the outer envelope of the fuel assembly and three of the corner seams are hinged so that removal of all the kingpins along a seam will enable two of the side walls to swing open and provide access to the interior of the tubular container. The tubular container or liner is designed to seat within an overpack for transport. The overpack is a tubular package having an axial dimension and a cross-section larger than the tubular liner. The overpack is split into a plurality of circumferential sections (for example, two sections, a lower support section and an upper cover, or three sections, a lower support section and two upper cover sections) that are respectively hinged to either circumferential side of the lower support section and joined together when the overpack is closed. The lower support section includes an internal central V-shaped groove that extends substantially over the axial length of the overpack a distance at least equal to the axial length of the tubular liner. Shock mounts extend from both radial walls of the V-shaped groove to an elevation that will support the tubular liner in space relationship to the groove. The axial location, number, size and type of shock mount employed are changeable to accommodate different loadings. The tubular liner is seated on the shock mounts, preferably with a corner of the liner aligned above the bottom of the V-shaped groove. The top cover section (sections) of the overpack has a complementary inverted V-shaped channel that is sized to accommodate the remainder of the tubular liner with some nominal clearance approximately equal to the spacing between the lower corner of the tubular liner and the bottom of the V-shaped groove. The ends of the overpack are capped and the overpack sections are latched.

Though the transport system of the '042 patent provides a substantial improvement in the protective characteristics and ease of loading and unloading of the nuclear components being transported, further improvement in the ease of loading and unloading the liner is desired. The invention of U.S. Pat. No. 7,474,726 assigned to the assignee of the current invention, was conceived for such purpose. The '726 patent is a variation on the '042 patent that permits loading of the liner from the top as well as the sides. The liner comprises an elongated tubular container that has at least two substantially flat walls with at least one circumferential end having a hinged interface with a stationary wall of the container to provide access through the side of the container. The hinged wall extends axially in a direction of one end of the container and terminates a preselected distance short of the corresponding end of the stationary wall. The stationary wall has a lateral groove on an interior surface thereof at an elevation starting substantially at the elevation of the one end of the hinged wall. An access cover is slidable in the groove in the stationary wall to close off the one end of the container so that the interior of the container may be accessed either through the one end by sliding out the access cover, or from the side by rotating the hinged wall. The access cover can be locked in position and the elongated tubular container has the other end opposite the one end capped and sealed and the tubular container is sized to fit within the overpack of the '042 patent.

While the '726 patent is a further improvement in the design of shipping casks which provides greater versatility in the number of fuel assembly designs that can be accommodated and the ease of loading, further improvement is still desired to accommodate an increased number of fuel assembly and component designs.

Accordingly, it is an object of this invention to further enhance the versatility of the shipping cask design described in the '726 patent.

It is an additional object of this invention to enhance the shipping cask design of the '726 patent so that it will accommodate all Westinghouse designed light water reactor nuclear fuel assemblies.

It is an additional object of this invention to further improve the shipping cask design of the '726 patent so that it will accommodate all CE designed light water reactor nuclear steam supply system fuel assemblies.

Furthermore, it is an object of this invention to further enhance the design of the '726 patent so that it will satisfy European and U.S. fuel transport regulations.

Furthermore, it is an object of this invention to further enhance the unirradiated nuclear fuel transport cask design of the '726 patent so that it will transport control rod spider assemblies in addition to nuclear fuel assemblies.

Additionally, it is an object of this invention to enhance the design of the '726 patent to provide a larger access envelope for the loading of a nuclear fuel assembly into the liner.

SUMMARY OF THE INVENTION

These and other objects are achieved by a shipping container system for transporting an unirradiated nuclear fuel product, that has an elongated tubular container with an access opening that extends over an elongated dimension of the tubular container and is designed to receive and support the nuclear fuel product. An interior of the tubular container has at least two substantially flat, movable walls and at least two substantially flat, stationary walls with a circumferential end of the at least two stationary walls connected together along the elongated dimension and another circumferential end of at least one of the stationary walls having a hinged interface with one circumferential end of at least one of the at least two movable walls. Another circumferential end of the at least one of the at least two movable walls is connected to one circumferential end of another of the at least two movable walls with another circumferential end of the another of the at least two movable walls connectable to another circumferential end of another of the at least two stationary walls. Each of the stationary walls and the movable walls have upper and lower ends and the stationary walls have at least one of either a bar or groove on an interior side of at least two of the stationary walls, proximate the upper end, that extend along at least a portion of the corresponding stationary walls substantially in a direction orthogonal to the axis of the elongated tubular container. The elongated tubular container also has a top plate that closes off a top of the container, with the top plate having at least two peripheral sides having the other of the one of a bar or groove extending substantially along at least a portion of an outer edge with the other of the one a bar or groove sized and oriented to mate with the corresponding one of the bars or grooves. The top plate also has an anchoring mechanism for supporting a side of the top plate against an abutting side of the one or the another of the at least two stationary walls.

The shipping container system also includes an elongated, tubular overpack having an axial dimension at least as long as the tubular container and an internal cross section larger than the tubular container. The overpack has an interior tubular channel having an axially extending lower support section supporting a plurality of shock mounts, with at least one of the plurality of shock mounts positioned on either radial side of the support section. The shock mounts support at least one of the flat walls of the tubular container in spaced relationship with the lower support section when the overpack is supported in a horizontal position. At least one circumferential end of the lower support section has a clamp interface substantially along the axial dimension thereof, to provide access to the interior of the overpack. Additionally, means are provided for supporting the overpack in a horizontal position.

In one embodiment, the anchoring mechanism is a placement rod having one end with a male locking contour which extends through a wall in the top plate and into an abutting opening in the one or the another of the at least two stationary walls, that has a complimentary female locking contour. Preferably, the male locking contour is a male threaded end of the placement rod and the complimentary female locking contour is a female thread on an interior surface of the abutting opening. Desirably, a hole in a wall of the top plate through which the placement rod extends includes a female thread that mates with the male thread on the placement rod and the male threaded end of the placement rod is tapered.

In still another embodiment, the one of the bars or grooves extends substantially across a full width of each of the walls and the another of the bars or grooves on the edge of the top plate extends substantially around the entire edge.

Preferably, the top plate includes at least two spaced openings extending through the top plate and through which push rods extend from above the top plate to an upper surface of the nuclear fuel product being transported. An axial length of the push rods within the interior of the elongated tubular container is adjustable from above the top plate on an exterior of the elongated tubular container. Desirably, the push rod adjustment includes a nut supported above the top plate on each push rod that is retained on the corresponding push rod by a locking pin. Preferably, the spaced openings through the top plate have female threads that mate with male threads on the push rods. Desirably, the top plate also includes a third spaced opening with the first two spaced openings located proximate diametrically opposed corners of the top plate and the third spaced opening located substantially in the center of the top plate. The top plate also includes motion sensors supported on its upper surface for recording the extent of excessive motion of the elongated tubular container. The sensors can be read from outside of the container without opening any of the walls. In addition, the elongated tubular container is preferably sized to transport both a nuclear fuel assembly and a control rod spider assembly.

BRIEF DESCRIPTION OF THE DRAWINGS

A further understanding of the invention can be gained from the following description of the preferred embodiments when read in conjunction with the accompanying drawings in which.

DESCRIPTION OF THE PREFERRED EMBODIMENT

Figure 1:
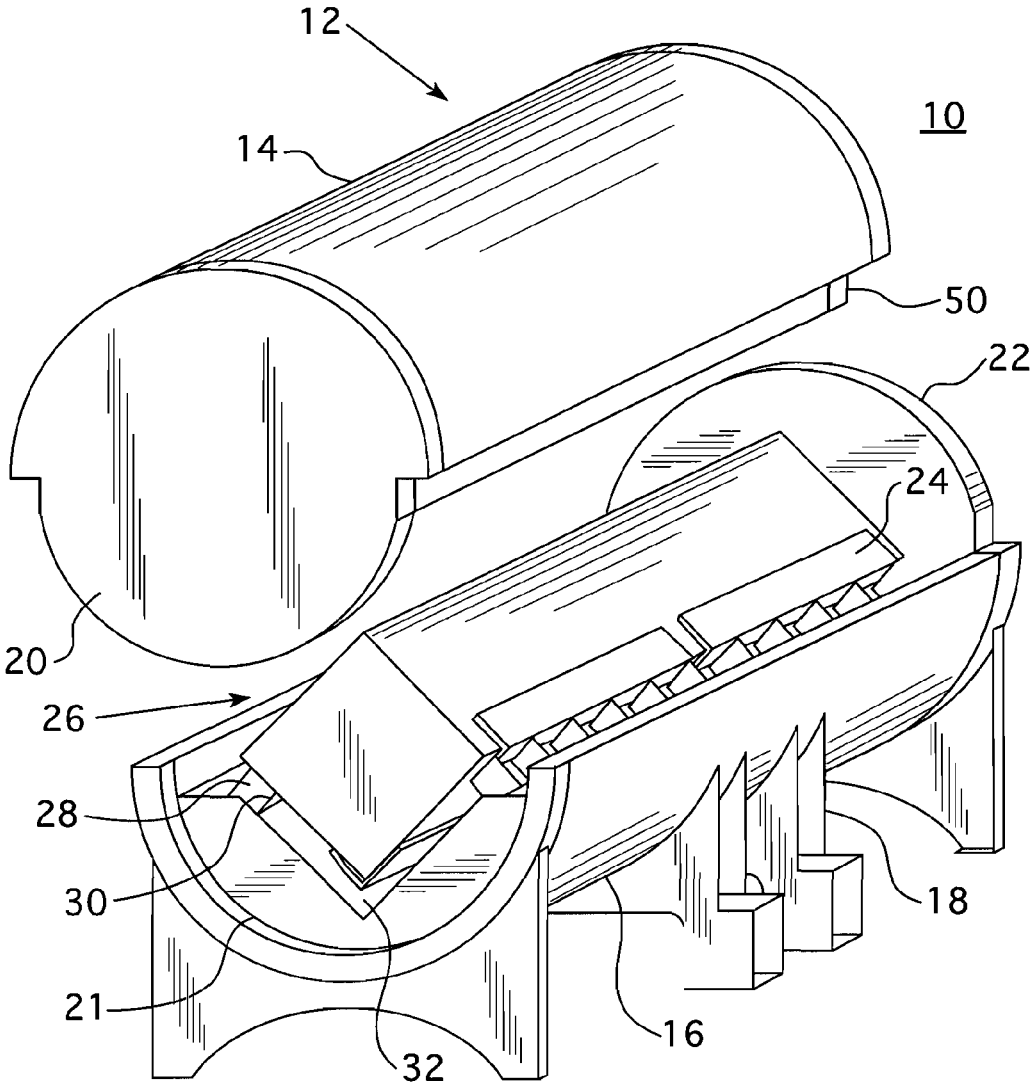
FIG. 1 Prior Art
FIG. 1 is a perspective view of prior art shipping container system in which this invention can be applied.

The overpack and internal components of the nuclear fuel product containment and transport system of this invention is an improvement on such systems described in U.S. Pat. Nos. 6,748,042 and 7,474,726, generally illustrated in FIG. 1. The system 10 includes a tubular container or shell 26 (sometimes referred to as a liner) constructed from a material such as aluminum that houses a nuclear fuel assembly and is suspended over a V-shaped groove 32 in an overpack 12, supported on shock mounts 28 that are affixed in a recess 30 in an upper wall section of the groove 32 and spaced along the axial length of the lower overpack section 16. The shock mounts can be those identified by part number J-34324-21, which can be purchased from Lord Corporation having offices in Cambridge Springs, Pa. Angle irons 24 can be used at the corners of the tubular container 26 to spread the load on the container walls. The number and resiliency of the shock mounts are chosen to match the weight of the container, which depends upon the nuclear product being transported within the container 26. The orientation of the lower section 16 of the overpack 12 is fixed by the legs 18 so that the weight of the container 26 holds the container centered in the groove 32. One capped end 22 forms part of the lower overpack support section 16, while a second capped end 20 is formed as an integral part of the top cover 14. The end 20 of the upper overpack segment 14 seals against the lip 21 in the lower support section 16. Similarly, though not shown, the end 22 formed as an integral part of the lower support section 16 seals against a corresponding lip on the upper overpack section 14 in the same manner. Keys 50 are on each side of the upper section 14 of the overpack 12 fit in complimentary key ways in the lower overpack support section 16.

Figure 2:
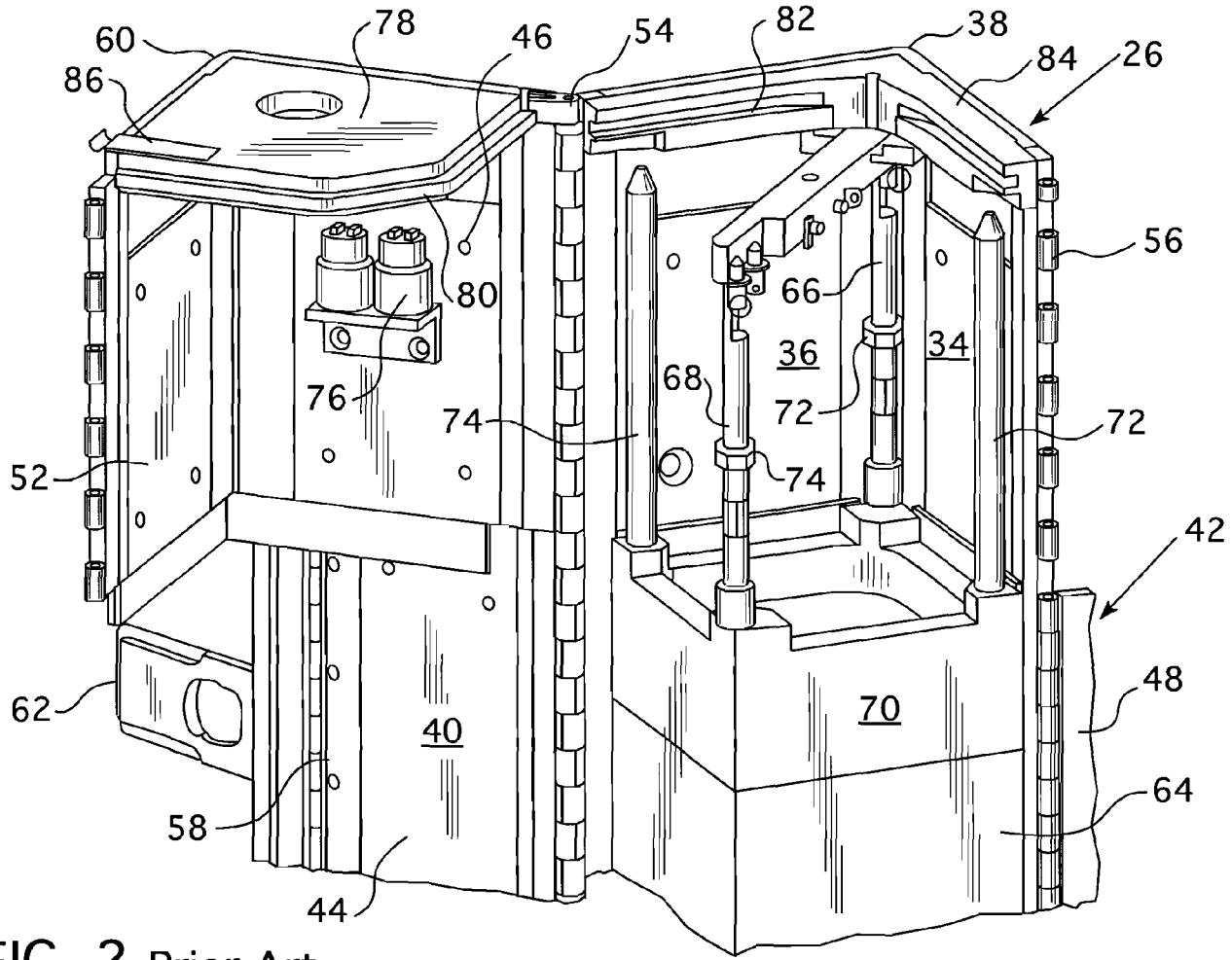
FIG. 2 Prior Art
FIG. 2 is an isometric view of an upper portion of the inner liner of a prior art shipping container system.

The liner or shell 26 illustrated in FIG. 1 is shown in more detail in FIG. 2. The liner 26 includes two stationary walls 34 and 36 that are rigidly coupled along a longitudinal seam 38 at one corner, such as by welding, though it should be appreciated that the walls 34 and 36 can be extruded as a single piece or rigidly connected in some other manner. Two movable walls 40 and 42 are respectively, hingedly connected to the stationary walls 36 and 34 at the hinged seams 54 and 56. The moveable wall 40 is formed in upper and lower halves 46 and 44 and the other movable wall 42 is similarly formed in upper and lower halves 52 and 48. The movable doors 40 and 42 may be hingedly connected as shown by the hinged seam 58 in the lower door 44. Alternatively, the movable walls 40 and 42 may be rigidly connected as shown by the fixed seam 60 in the upper doors 46 and 52. Alternatively, the movable walls may merely be latched together as an indicated by the latch plate 62.

A square fuel assembly 64 is shown supported within the interior of the liner 26. Push rods 66 and 68 exert pressure on diagonally opposite corners of the top fuel assembly nozzle 70 to secure the fuel assembly axially as well as radially. Alignment pins 72 and 74 are part of the fuel assembly 64 and serve to align the fuel assemblies with an upper core plate in a nuclear reactor. The push rods 66 and 68 include adjustment nuts 96 that are employed to adjust the length of the push rods 66 and 68 to securely pressure the fuel assembly 64 after it is loaded within the liner 26. Accelerometers 76 are supported on the inside of the upper wall 46 to record any shocks the liner 26 may receive. As noted in the '042 patent, additional stationary walls may be added to accommodate a hexagonal fuel assembly or a fuel assembly having another geometry. The liner illustrated in FIG. 2 is capped at its upper end by a top plate 78 that has a peripheral lip 80 surrounding its outer edge that mates with a corresponding groove 82 in the upper portion of the liner 26. The lip 84 above the groove 82 has proved to be an obstruction to loading certain fuel assembly designs. The spring 86 that is cantilevered over the edge of the top plate 78 is provided to retain the top plate with the movable upper wall portions 46 and 52 when the upper wall portions are swung to the open position.

Figure 3:
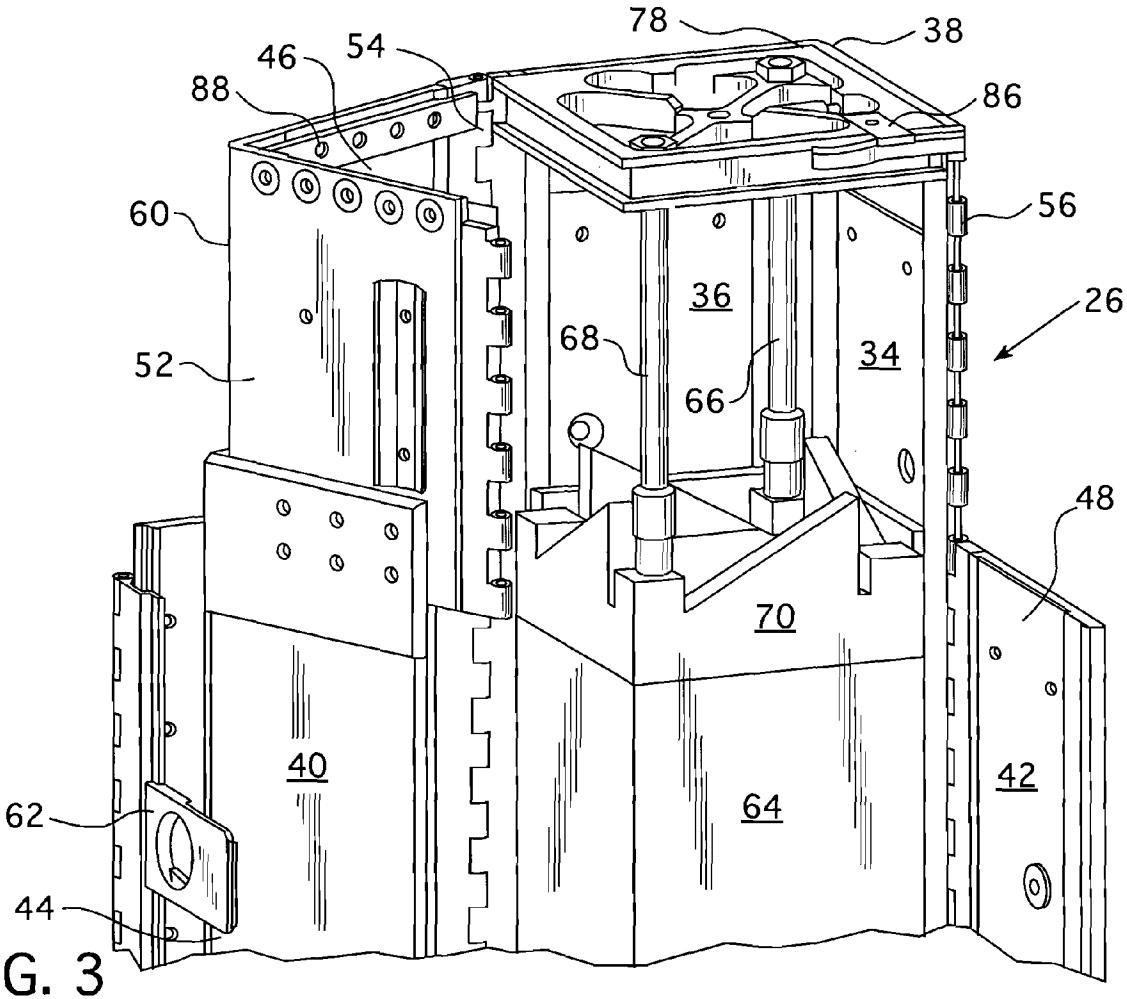
FIG. 3 is an isometric view of the upper portion of the liner of the shipping container system of this invention.

FIG. 3 illustrates the improvement that this invention contributes to the design shown in FIG. 2. Like reference characters are employed to identify the corresponding components. The improvement of this invention provides a newly designed top shear plate 78 that replaces the top plate 78 and wall interfaces 82 and 84 previously described with respect to FIG. 2. Referring to FIG. 3 it will be appreciated that the positioning of the hold down or push rods 66 and 68 and the location of the accelerometers 76 have changed to facilitate ease of use and make the liner 26 compatible for all Westinghouse pressurized water reactor nuclear steam supply system and non-Westinghouse pressurized water reactor nuclear steam supply system fuel assembly designs, including CE, ATOM and B&W fresh fuel assembly designs. The improvement of this invention further comprises a machined aluminum top sheer plate designed to fit the liner previously described, which maintains the fuel assembly axial, lateral and vertical position during transport. The shear top plate has three universal threaded holes to permit transport of Westinghouse and non-Westinghouse pressurized water reactor nuclear fuel assembly designs mentioned previously.

Figure 4:
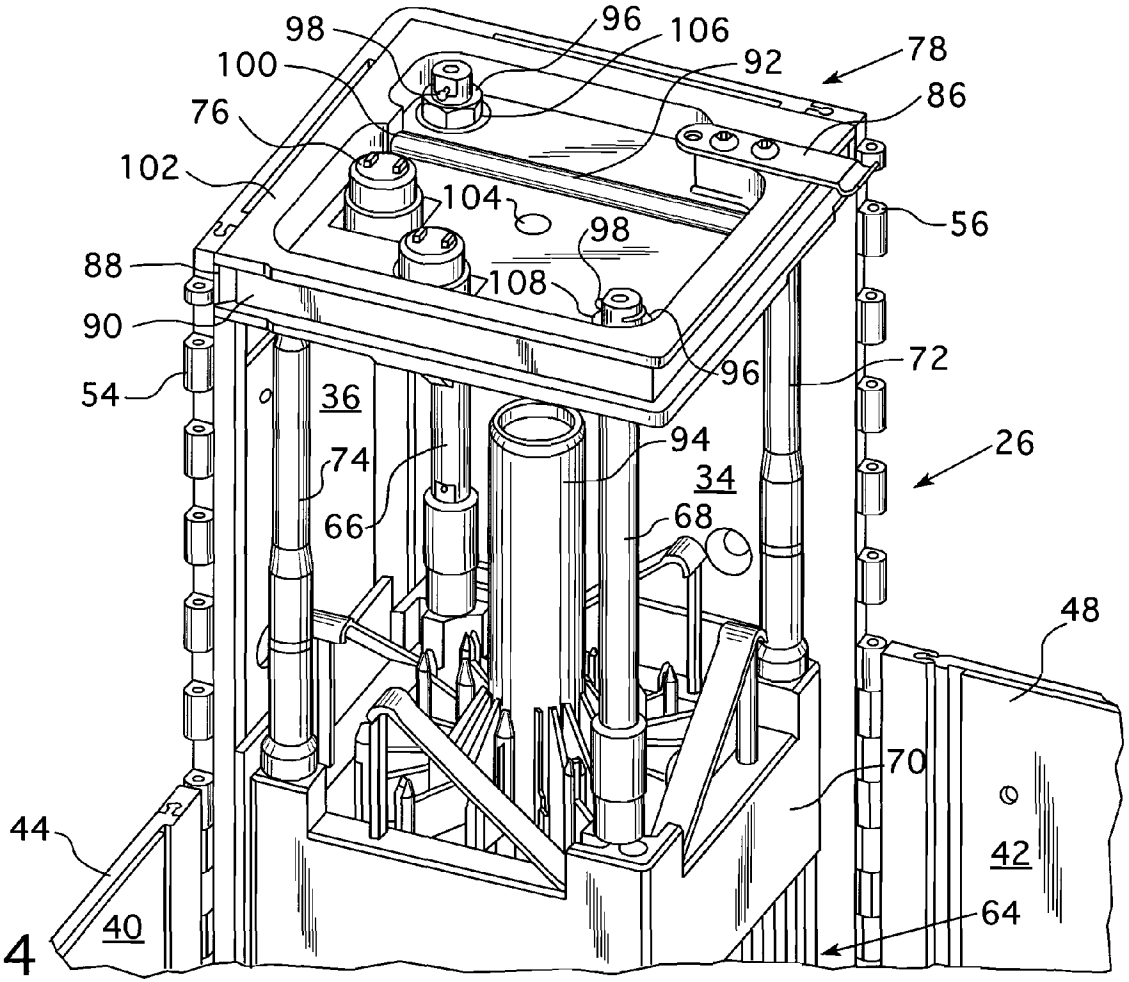
FIG. 4 is an enlarged isometric view of the liner shown in FIG. 3 with the top doors removed for clarity and a fuel assembly and control rod spider assembly secured in place.

FIG. 4 provides a better view of the shear top plate 78 of this invention affixed at the top of the two stationary walls 34 and 36 of the liner 26. The upper portions 46 and 52 of the movable walls 40 and 42 have been removed for clarity. The fuel assembly 64 is shown within the liner with the control rods of a control rod spider assembly inserted within the guide thimbles of the fuel assembly 64. The shear plate 78 has a bordering rail 102 that extends along the periphery of the shear top plate 78. The bordering rail 102 has a groove 90 that extends around its peripheral edge and mates with a horizontal bar or rail 88 on each of the liner walls 34, 36, 40 and 42. The bars 88 are affixed to the liner walls near the top of the liner and may extend across all or part of the width of each wall and is sized to mate with the groove 90 in the peripheral edge of the shear top plate 78.

Push bars (also referred to as hold down bars) 66 and 68 extend from the corners of the top nozzle 70 of the fuel assembly 64, upward and through diametrically opposed corner openings 106 and 108 in the top shear plate 78 and are locked in position by adjustment nuts 96. The openings 106 and 108 are threaded and mate with corresponding male threads on the push rods 66 and 68 near the upper end thereof. Cotter pins 98 prevent the adjustment nuts 96 from unscrewing from the ends of the push rods 66 and 68. The push rods 66 and 68 can be tightened down against the diametrically opposite corners of the fuel assembly top nozzle 70 by applying a torque wrench to the ends of the push rods above the shear plate 78 and then tightening down the nuts 96.

Accelerometers 76 are affixed to the upper surface of the top shear plate 78 and can be read without opening the liner 26.

A placement rod 92 extends through an opening in the border rail 102 and into a hole in the stationary wall 36. The engagement end 100 of the placement rod 92 has a male thread which mates with a female thread in the opening in the border rail 102 and the aligned hole in the wall 36 (not shown). Preferably, the thread on the end 100 of the placement rod 92 is tapered.

A third hole 104 is provided through the center of the top shear plate 78 to accommodate a third push rod 110 that can be used to further secure the fuel assembly 64 or other fuel components such as the control rod spider assembly 94.

Figure 5:
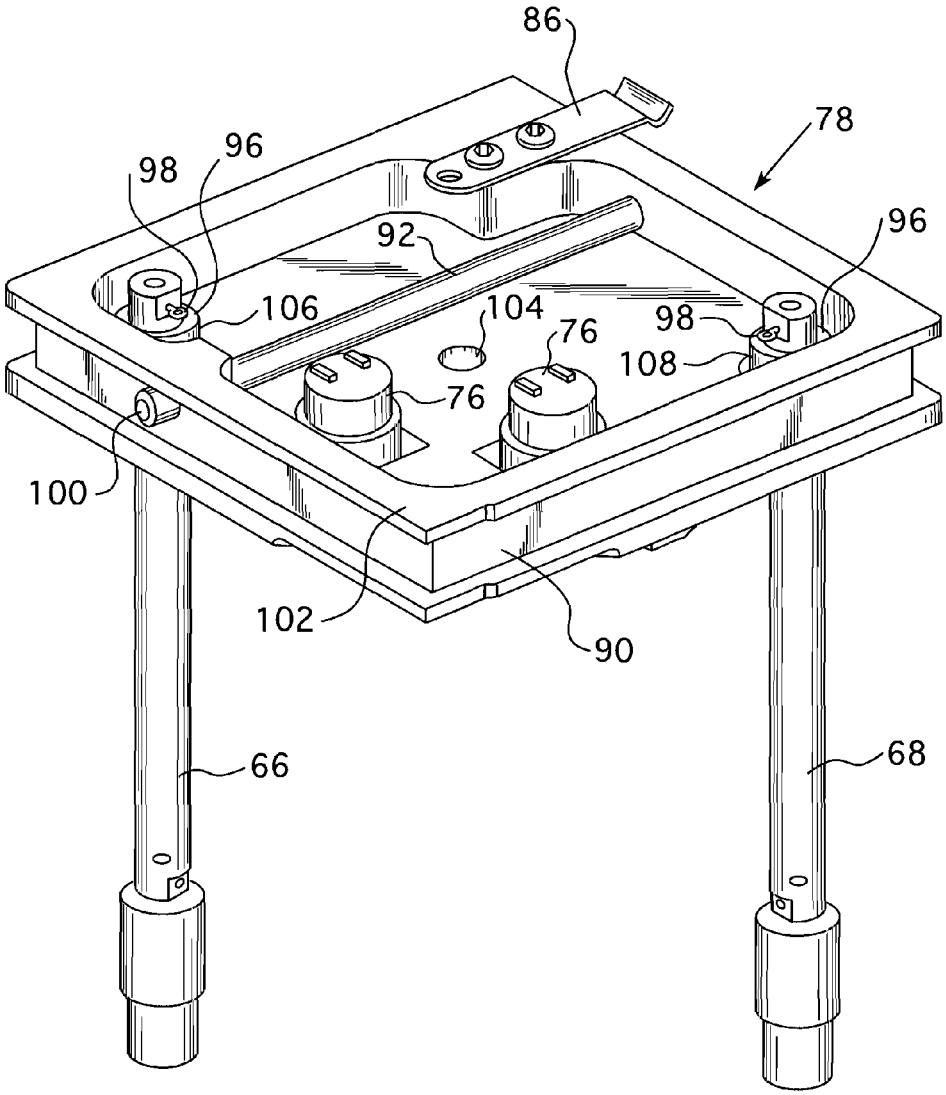
FIG. 5 is an isometric view of the top shear plate shown in FIG. 4 taken at an angle viewed from above the shear plate.
Figure 6:
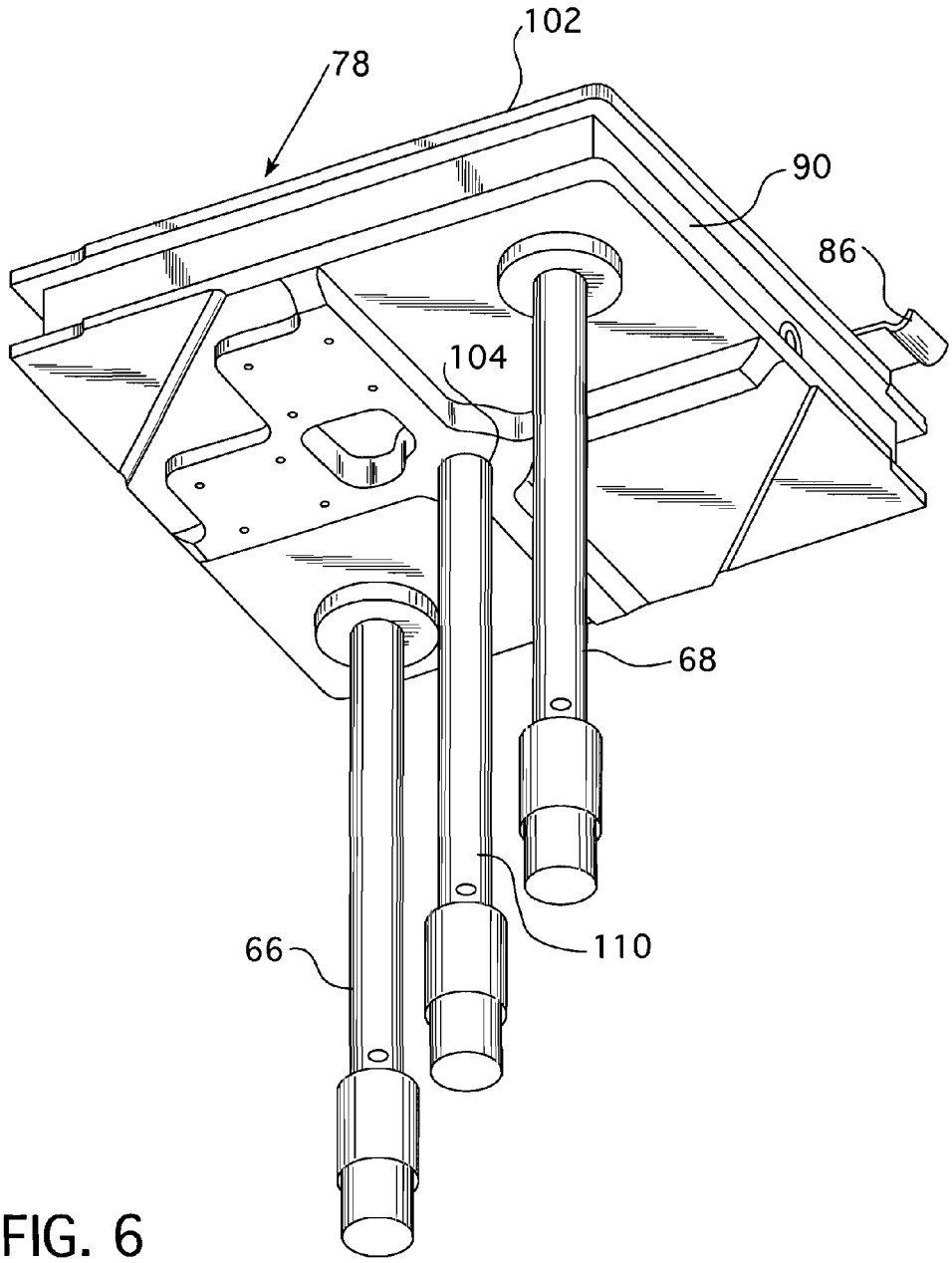
FIG. 6 is an isometric view of the shear plate shown in FIG. 5 taken at an angle viewed from below the shear plate.

FIGS. 5 and 6 provide isometric views of the top shear plate and its components, taken from different angles. The views shown in FIGS. 5 and 6 provide a better understanding of the components of the top shear plate 78 of this invention.

While specific embodiments of the invention have been described in detail, it will be appreciated by those skilled in the art that various modifications and alternatives to those details could be developed in light of the overall teachings of the disclosure. Accordingly, the particular embodiments disclosed are meant to be illustrative only and not limiting as to the scope of the invention which is to be given the full breadth of the appended claims and any and all equivalents thereof.

What is claimed is:

1. A shipping container system for a first nuclear fuel product comprising:

an elongated tubular container having an axis extending along an elongated dimension of the container, the container being designed to receive and support the first nuclear fuel product therein, an exterior of the tubular container having at least two substantially flat, movable walls and at least two substantially flat, stationary walls with a circumferential end of the at least two stationary walls connected together along the elongated dimension and another circumferential end of at least one of the stationary walls having a hinged interface with one circumferential end of at least one of the at least two movable walls, another circumferential end of the at least one of the at least two movable walls being connected to one circumferential end of another of the at least two movable walls with the another circumferential end of the another of the at least two movable walls connectable to another circumferential end of another of the at least two stationary walls, with each of the stationary walls and the movable walls having an upper and lower end and the stationary walls having at least one of either a bar or groove on an interior side of at least two of the stationary walls, proximate the upper end, that extend along at least a portion of the corresponding stationary walls substantially in a direction orthogonal to the axis, the elongated tubular container having a top plate that closes off a top of the elongated tubular container, with the top plate having at least two peripheral sides having the other of the one of a bar or groove extending substantially along at least a portion of an outer edge with the other of the one of the bar or groove sized and oriented to mate with the one of the bar or groove and an anchoring mechanism for supporting a side of the top plate against an abutting side of the one or the another of the at least two stationary walls, the top plate having at least one wall that extends parallel to the one or the another of the at least two stationary walls with the anchoring mechanism having an elongated dimension with one end extending through the wall in the top plate and into the at least one or the another of the two stationary walls that the wall in the top plate is parallel to, the anchoring mechanism being anchored within the at least one or the another of the two stationary walls that the wall in the top plate is parallel to and restrained within the at least one or the another of the two stationary walls that the wall in the top plate is parallel to, in a direction along the elongated dimension of the anchoring mechanism;

an elongated, tubular overpack having an axial dimension at least as long as the tubular container, an internal cross-section larger than the tubular container and an interior tubular channel having an axially extending lower support section supporting a plurality of shock mounts, with at least one of said plurality of shock mounts positioned on either radial side of the lower support section, the shock mounts support at least one of the flat walls of the tubular container in spaced relationship with the lower support section when the overpack is supported in a horizontal position, with at least one circumferential end of the lower support section having a clamped interface substantially along the axial dimension thereof to provide access to the interior of the overpack; and a stand configured to support the overpack in a horizontal position.

2. The shipping container system of claim 1 wherein the anchoring mechanism is a placement rod having one end with a male locking contour which extends through the wall in the top plate and into an abutting opening in the one or the another of the at least two stationary walls, that has a complimentary female locking mechanism.

3. The shipping container system of claim 2 wherein the male locking contour is a male threaded end of the placement rod and the complimentary female locking mechanism is a female thread on an interior surface of the abutting opening.

4. The shipping container system of claim 3 wherein a hole in the wall in the top plate through which the placement rod extends includes a female thread that mates with the male thread on the placement rod.

5. The shipping container system of claim 3 wherein the male threaded end of the placement rod is tapered.

6. The shipping container system of claim 1 wherein the one of the bars or grooves extend substantially across a full width of each of the walls and the another of the bars or grooves on the edge of the top plate extends substantially around the entire edge.

7. The shipping container system of claim 1 wherein the top plate includes at least two spaced openings extending through the top plate and through which push rods extend from above the top plate to an upper surface of the first nuclear fuel product, wherein an axial length of the push rods within an interior of the elongated tubular container is adjustable from above the top plate on an exterior of the elongated tubular container.

8. The shipping container of claim 7 wherein the adjustment includes a nut supported above the top plate on each push rod and retained on the push rods by locking pins.

9. The shipping container system of claim 7 wherein the spaced openings have female threads that mate with male threads on the push rods.

10. The shipping container system of claim 7 including a third spaced opening in the top plate.

11. The shipping container system of claim 10 wherein the top plate has diametrically opposed corners and the two spaced openings are located proximate the diametrically opposed corners and the third spaced opening is located substantially in the center of the top plate.

12. The shipping container system of claim 7 wherein the top plate has diametrically opposed corners and the two spaced openings are located proximate the diametrically opposed corners.

13. The shipping container system of claim 1 including motion detectors for recording the extent of excessive motion of the elongated tubular container, wherein the extent of excessive motion can be read from an outside of the elongated tubular container without opening any of the walls.

14. The shipping container system of claim 13 wherein the motion detectors are secured to an upper side of the top plate.

15. The shipping container system of claim 1 wherein the first nuclear fuel product includes a nuclear fuel assembly and a control rod spider assembly.

16. The shipping container system of claim 1 wherein the one of either the bar or groove is a bar and the another of the bar or groove is a groove.

17. An elongated tubular shipping container having an axis extending along an elongated dimension of the container, the container being designed to receive and support a first nuclear fuel product therein, comprising:

an exterior of the tubular container having at least two substantially flat, movable walls and at least two substantially flat, stationary walls with a circumferential end of the at least two stationary walls connected together along the elongated dimension and another circumferential end of at least one of the stationary walls having a hinged interface with one circumferential end of at least one of the at least two movable walls, another circumferential end of the at least one of the at least two movable walls being connected to one circumferential end of another of the at least two movable walls with the another circumferential end of the another of the at least two movable walls connectable to another circumferential end of another of the at least two stationary walls, with each of the stationary walls and the movable walls having an upper and lower end and the stationary walls having at least one of either a bar or groove on an interior side of at least two of the stationary walls, proximate the upper end, that extend along at least a portion of the corresponding stationary walls substantially in a direction orthogonal to the axis; and the elongated tubular container having a top plate that closes off a top of the elongated tubular container, with the top plate having at least two peripheral sides having the other of the one of a bar or groove extending substantially along at least at least a portion of an outer edge with the other of the one of the bar or groove sized and oriented to mate with the one of the bar or grooves and an anchoring mechanism for supporting a side of the top plate against an abutting side of the one or the another of the at least two stationary walls, the top plate having at least one wall that extends parallel to the one or the another of the at least two stationary walls with the anchoring mechanism having an elongated dimension with one end extending through the wall in the top plate and into the at least one or the another of the two stationary walls that the wall in the top plate is parallel to, the anchoring mechanism being anchored within the at least one or the another of the two stationary walls that the wall in the top plate is parallel to and restrained within the at least one or the another of the two stationary walls that the wall in the top plate is parallel to, in a direction along the elongated dimension of the anchoring mechanism.

* * * * *